US006062792A

United States Patent [19]

Garrity

[11] Patent Number: 6,062,792

[45] Date of Patent: May 16, 2000

[54] BINDING APPARATUS

[75] Inventor: David Francis Garrity, Halifax, United Kingdom

[73] Assignee: Heights Design Production Limited, Halifax, United Kingdom

[21] Appl. No.: 09/097,634

[22] Filed: Jun. 16, 1998

[30] Foreign Application Priority Data

Jun. 18, 1997 [GB] United Kingdom ..... 9712718

[51] Int. Cl.[7] ..... B42B 5/10

[52] U.S. Cl. ..... 412/39; 412/1; 412/6; 412/7; 412/38; 412/40

[58] Field of Search ..... 412/1, 6, 7, 38, 412/39, 40

[56] References Cited

U.S. PATENT DOCUMENTS 4,934,890 6/1990 Flatt ..... 412/39

5,059,078 10/1991 Schmid ..... 412/40

*Primary Examiner*—Willmon Fridie, Jr.
*Assistant Examiner*—Mark T. Henderson
*Attorney, Agent, or Firm*—Adams Law Firm, P.A.

[57] ABSTRACT

An elongate binding member 10 is initially open. A series of loops extend along the open edges and these are suspended from a row of holding teeth 12. The other loops are exposed and pages 9 are threader over the exposed loops to be suspended downwardly from the binder.

The binder is closed by pulling a lever 32 which brings a former 36 against the binder and moves the former 36 towards another former 16 to bend the wire loops towards each other to close the binder

32 Claims, 5 Drawing Sheets

BINDING APPARATUS

The present invention relates to binding apparatus and to a method of binding.

BACKGROUND OF THE INVENTION

In a known apparatus for binding pages on a metal binder the pages have holes punched along one edge. An open wire binder of curved cross section has one edge slid into an elongate slot to support the binder. The pages are then fed over the hooks presented by the other edge of the binder to be supported by the binder. Then the assembly of the binder and pages is slid carefully out of the slot to ensure that the pages remain attached with the binder being located in an outwardly facing channel. When locating the binder, the open edges of the binder must be manoeuvred such that they face away from the now horizontal pages and the binder must be held in that position. This procedure is time consuming and can result in pages coming off the binder during the manoeuvring of the assembly. Then the upper face of the channel is driven downwardly to decrease the height of the channel and to bend the binder into a closed position such that the free edges of the binder are brought towards each other and lie in the same axial extent.

It is difficult to ensure that the correct edges of the binder are brought into the correct position in the channel and it is often the case that the binder takes up a non-circular, non-desirable shape as a result of one free edge of the binder being closer to the top or bottom of the channel that the other edge is to its associated part of the channel.

Furthermore the binder has to be held in the channel before the crushing action commences, which is a difficult task for an operator who must also operate a mechanism to close the channel.

It is an object of the present invention to attempt to overcome at least some of these disadvantages.

BRIEF SUMMARY OF THE INVENTION

According to one aspect of the present invention binding apparatus includes a support for one elongate edge of an open binder and first and second formers movable relative to each other towards each other, the movement of the formers being arranged, in use, to bring opposed edges of the binder towards each other to close a binder.

One elongate edge of a binder may be arranged to be supported such that the other edge is arranged to receive pages to be bound.

The edge of a binder that is not supported may be arranged to face upwardly. The portion of a binder between the edges, on the inside of the binder, may be arranged to face upwardly.

A binder may be arranged to be supported by being suspended from the support and having an outer surface of the binder resting against the first former. The support may also be arranged to restrict movement of the binder away from the first former.

The support for a binder may be arranged to support loops on a binder that extend along the length of the binder and the support may be arranged to support each loop.

The support may be arranged to overhang the first former. The extent of the overhang may be adjustable. The support may be movable in a direction transverse to the overhang, for instance by being against a spring force.

The relative position of the support of the first former may be adjustable in a direction extending between the first and second formers.

The position of the first and second formers may be adjustable relative to each other prior to the first and second formers being moved to bring the open edges of a binder towards each other.

The or each adjustment may be arranged to be effected by a cam. Movement of a single member may be arranged to effect adjustment of the support and the first former. Adjustment of the support and the adjustment of the first former may be arranged to occur simultaneously. The adjustment may be arranged to occur against a resilient bias.

The first and second formers may have generally upwardly, and possibly substantially vertically extending faces that are arranged to effect closure of a binder.

The second former may be arranged to be brought towards the first former to close a binder by causing relative translational movement of the formers.

The second former may be movable from a first position, in which it is clear of the first former to a second position in which the second former can be moved towards the first former to close a binder. The first position of the second former may be a raised position. The second former may be arranged to be pivoted to the first position. A single movement of an operating member may be arranged to bring the second former from the first position to a position in which it opposes the first former and then towards the first former to close a binder.

The second former may be arranged always to move the same distance during movement towards the first former in order to close a binder regardless of the size of the binder that is being closed.

According to another aspect of the present invention a method of binding an elongate binder having opposed spaced edges along its elongate extent comprises supporting the binder at one edge thereof and causing relative movement of the opposed formers towards each other in order to bring the opposed edges of the binder towards each other.

The method may comprise locating pages to be bound over the other edge while the one edge is supported, prior to the relative movement of the opposed edges occurring.

The method may comprise supporting the binder at one edge by suspending the binder.

The method may comprise allowing an outer edge of the binder to bear against one of the formers prior to the formers moving towards each other.

The method may comprise the support for the binder at one edge moving in a direction transverse to the extent between the opposed formers or, alternatively or additionally in the general direction between the formers, for instance against a resilient bias, either when pages are being loaded onto the binder or when the opposed edges of the binder are moved towards each other or both.

The method may comprise altering the relative distance of one of the formers adjacent to the edge of the binder that is to be supported and the support for the edge of a binder in the general direction that the formers are arranged to move to bring opposed edges of a binder towards each other.

The method may comprise moving one of the formers to oppose the other prior to moving the formers relative to each other to bring opposed edges of the binder towards each other.

The method may comprise moving a former or moving a support for one edge of a binder by means of a cam or against resilient means or simultaneously or any combination thereof.

The method may comprise causing one of the formers only to move when bringing the opposed edges of the binder towards each other. The method may comprise always moving that former to the same extent, regardless of the size of a binder whose edges are moved towards each other.

The method may comprise supporting a binder comprising a single elongate component formed to present loops along each elongate edge with the loops along one edge, and possibly each loop along that edge, being supported.

The method may comprise moving one of the formers from a first position in which it is clear of the other former, in order that the binder can be mounted on the support, to a second position in which it is in the region of the other support and then moving the formers relative to each other to bring the opposed edges of the binder towards each other.

The method may comprise moving the former from the first position to the second position and then causing that former to move towards the other former to bring the edges of the binder towards each other in one continuous movement or on operation of one member. That movement of the former may initially be arcuate and subsequently translational.

BRIEF DESCRIPTION OF SEVERAL VIEWS OF THE DRAWINGS

The present invention can be carried into practice in various ways, but one embodiment will now be described, by way of example, and with reference to the accompanying drawings, in which.

DETAILED DESCRIPTION OF THE INVENTION

Figure 1:
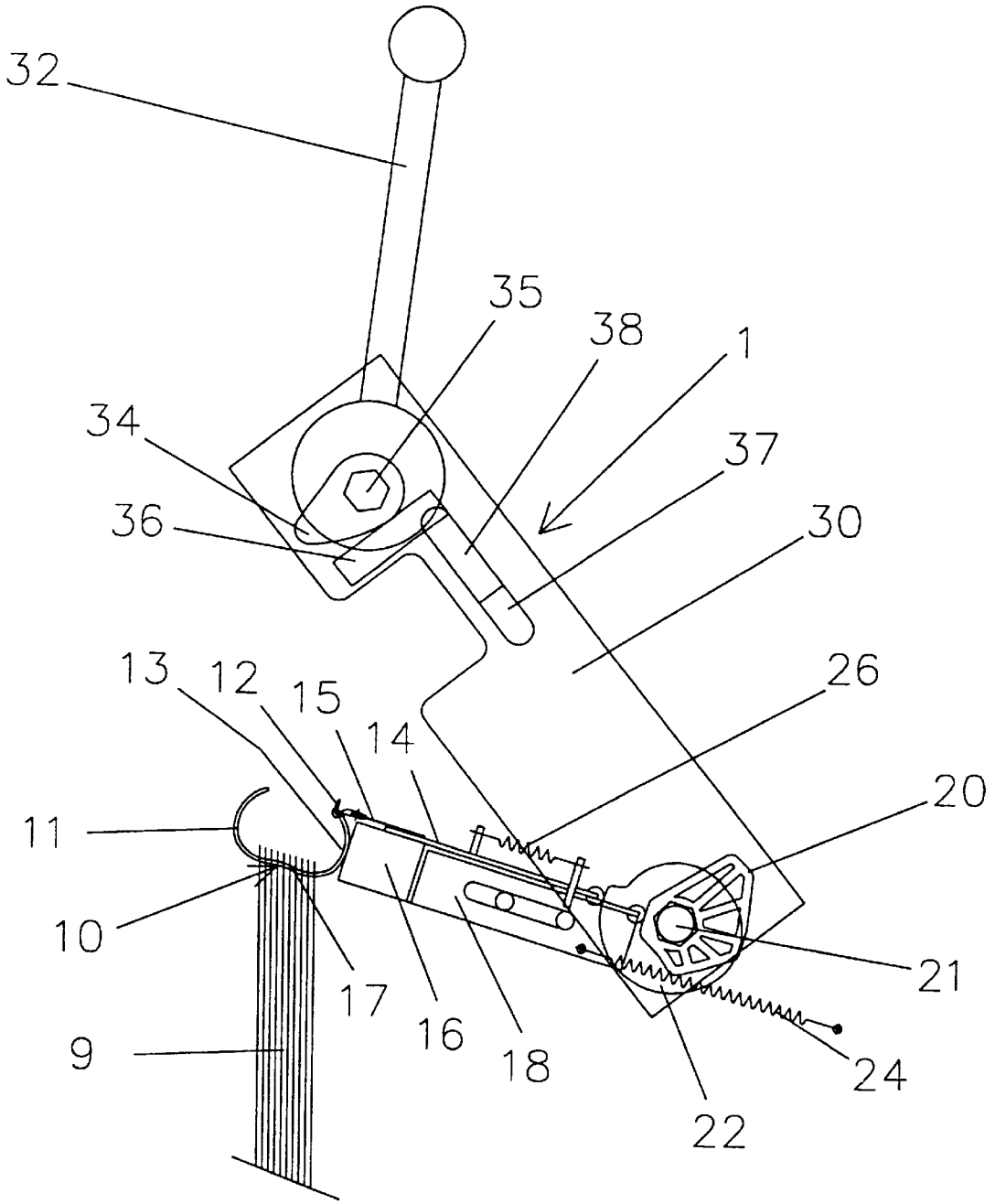
FIG. 1 is a cross-sectional view of the binding apparatus in an open position.

The binding apparatus 1 is arranged to bind together a plurality of pages 9 (shown schematically) using a binding member 10. The binding member is made from a single section of wire and is formed into an open elongate member having two opposing faces 11 and 13 and a lower face having an upwardly projecting ridge 17. The binding member 10 is formed such that the wire extends up along and down a first face, and then traverses the lower face and the ridge 17, and subsequently extends up, along and down the second opposing face to form loops at the upper end of each face. This looped formation continues along the length of the binding member 10. Consequently, the opposing faces of the binding member 10 have upwardly projecting loops formed by the wire. The loops on the inner face 13 are approximately twice the width of the loops on the outer face 11.

A row of holding teeth 12 are moulded on to a spring plate 15 which is made from sprung steel. The row of holding teeth support the binding member 10 through the register of each holding tooth 12 with a respective loop of wire along the inner face 13 of the binding member 10. Preferably, although not essentially, each loop of wire along the inner face 13 has a corresponding holding tooth 12.

The spring plate 15 is attached by means 40 to a carrier plate 14. The carrier plate 14 is on a support member 18.

A tension spring 26 is connected between the carrier plate 14 and the rear end of the support 18 as shown in FIG. 1 to bias the rear edge of the carrier plate 14 to abut cams 22 at each side. A hexagonal shaft 21 (shown schematically) extends across the width of the binding apparatus 1 and supports the spaced apart cams 22.

Figure 2:
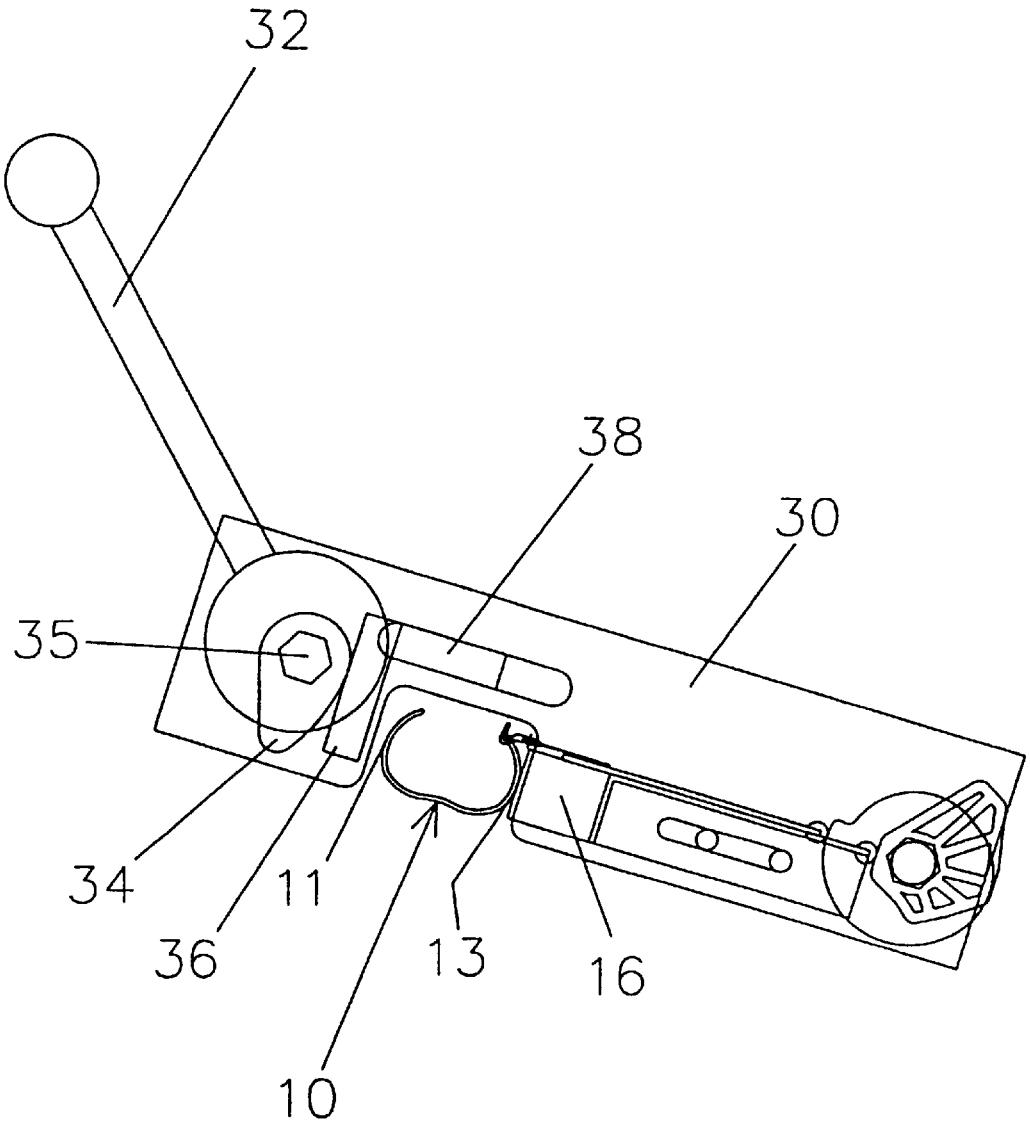
FIG. 2 is a cross-sectional view of the binding apparatus in a closed position.
Figure 3:
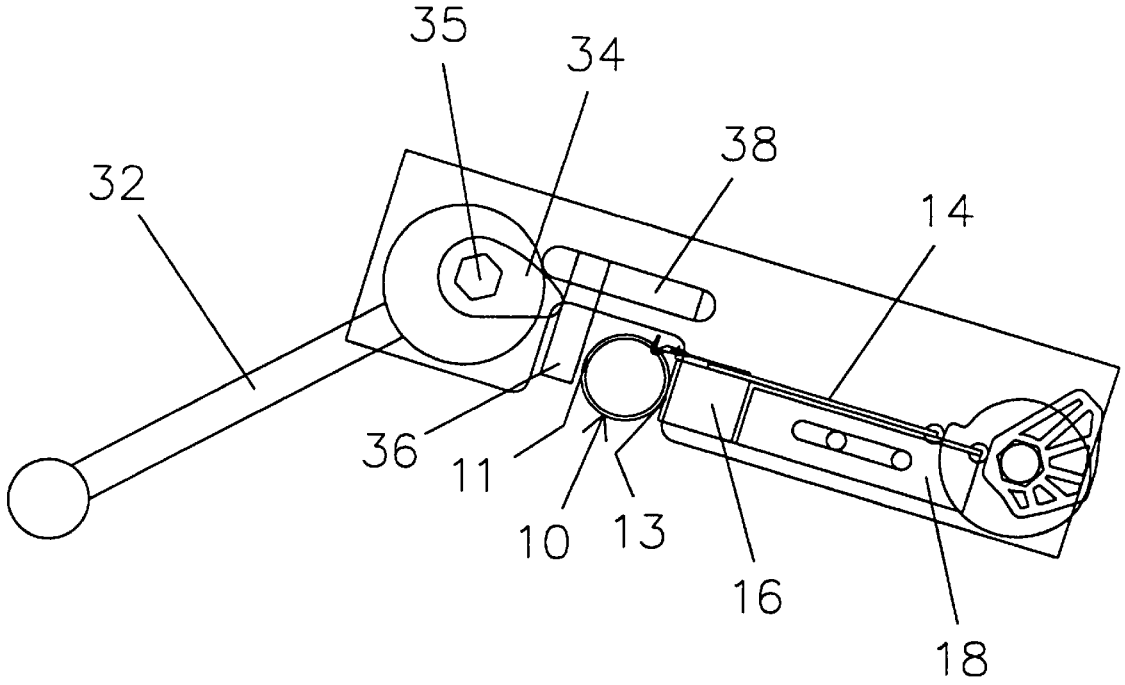
FIG. 3 is a cross-sectional view of the binding apparatus in a final position.
Figure 4A:
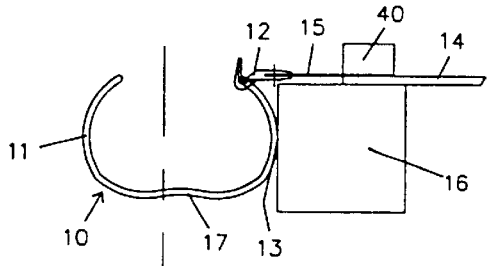
FIGS. 4A–4E are cross-sectional views showing the initial configurations of holding teeth and a former for different sized binding members.
Figure 4B:
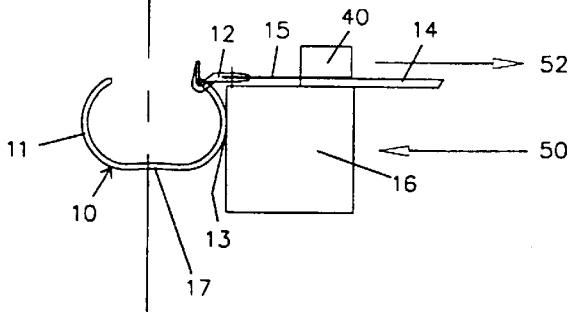
Figure 4C:
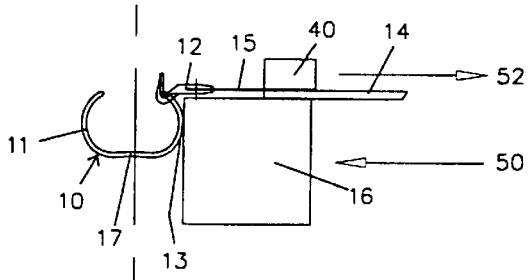
Figure 4C:
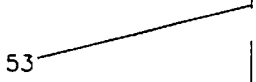
Figure 4D:
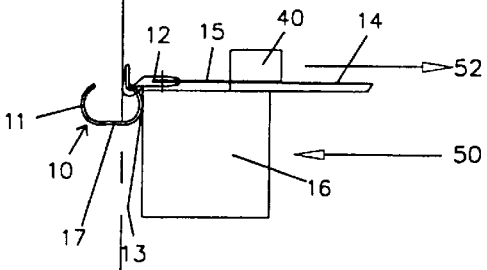
Figure 4E:
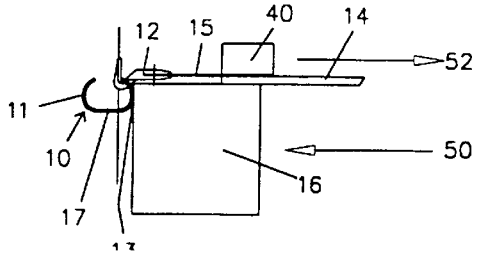
Figure 5A:
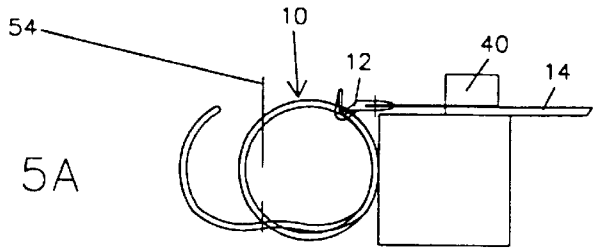
FIGS. 5A–5E are cross-sectional views showing initial and final shapes for different sized binding members.
Figure 5B:
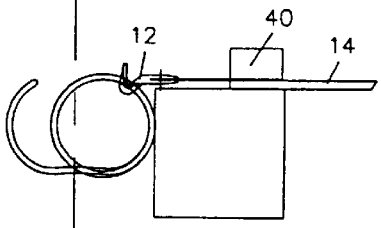
Figure 5C:
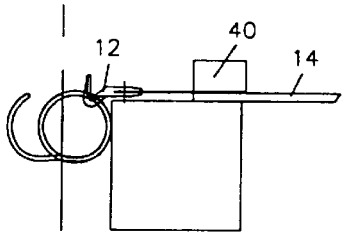
Figure 5D:
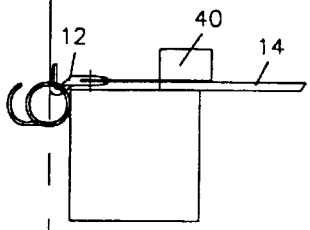
Figure 5E:
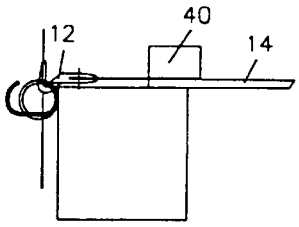

A former 16 provides support along the elongate extent of the outer periphery of the face 13 of the binding member 10 to retain the binding member 10 in the position shown in FIG. 1. That support face is shown in FIGS. 1 to 3 at an angle to the vertical although, if desired, the face may be vertical. The opposite face of the former is connected to the adjacent surface of the support 18. The support 18 is attached to the main body of the binding apparatus by a tension spring 24 which holds the rear surface of the support 18 against spaced cams 20. The cams 20 are located on the hexagonal shaft 21 towards each side of the binding apparatus, inwards of each cam 22.

As shown in FIG. 1, a pair of connected closer members 30 extend upwardly and are pivotally mounted at each side of the shaft 21. A former 36 extends between an upper part of the closer members with the former being movable in a radial direction with respect to the axis of the shaft 21.

A number of cams 34 which are located along a hexagonal shaft 35 contact the outer face of the movable former 36 as shown in FIG. 1. Rotation of the hexagonal shaft 35 relative to the members 30 causes rotational movement of the cams 34 which thereby effects translational movement of the former 36 radially inwards towards the axis of the shaft 21. That inwards movement is guided by a plate 38 connected to the former 36 that slides in a slot 37 formed in each member 30. A locking mechanism is arranged such that rotation of the hexagonal shaft 35 relative to the former 36 is only possible when the closer members 30 are in the crush position shown in FIG. 2. That locking mechanism may comprise arcuate plates at each side of the machine against which the inner surface of the plate 38 bears during downwards pivotal movement of the members 30 with that abutment of the plate 38 holding the former out and preventing rotation of an operating handle 32 about the shaft 21. The arcuate plates may have slots in the region of the former 16 to allow the plate 38 to slide in when it reaches those slots to effect the bending action only when the formers are correctly aligned with each other.

The rotational movement first about the shaft 21 and then about the shaft 35 is manually controlled through the handle 32. Thus the handle 32 controls the movement of the closer members 30 from the open position of FIG. 1 to the crush position of FIG. 2.

A dial (not shown) controls the orientation of the cams 20 and 22. Rotational movement of the cam 22 causes translational movement of the carrier plate 14 generally radially with respect to the shaft 21 and similarly rotation of the cam 20 causes translational movement of the support 18 in the same direction. The dial (not shown) thereby independently and simultaneously controls the distance of the holding teeth 12 and front face of the former 16 relative to a centre line 54 shown in FIGS. 4 and 5 thereby enabling a variety of different sized binding members 10 to be used.

The shape of the cams 22 and 20 are such that only one dial is needed to adjust the binding apparatus 1 for different sized binding members 10. Configurations for different sized binding members 10 are illustrated in FIGS. 4A–4E. The dial (not shown) causes the former 16 to move in the direction of arrow 50, whilst, simultaneously causing the holding teeth 12 to move in the direction of arrow 52

(relative to the former 16) in order to accommodate a smaller binding member 10, as shown sequentially in FIGS. 4A to 4E.

The operation of binding a plurality of pages together by the binding member 10 using the binding apparatus 1 will now be described with reference to the sequence of the diagrams shown in FIGS. 1 to 3.

Firstly, the dial (not shown) is set to adjust the configuration of the holding teeth 12 and the former 16 to accommodate the size of the binding member 10.

As shown in FIG. 1, the binding member 10 is manually located on the holding teeth 12. This is aided by the good visibility allowed due to the binding apparatus 1 being in the open position.

Binding holes are stamped along the relevant spines of the pages 9 to be bound, such that each hole corresponds with a respective wire loop provided on the outer face 11 of the binding member 10. The pages are then manually located on to the binding member 10 through the register of each binding hole along the spine of the pages with a wire loop on the outer face 11 of the binding member 10. The pages 9 are released and hang downwardly The weight of the pages 9 on the binding member 10 causes the teeth 12 to move downwardly as a result of the flexure of the part of the spring plate 15 that projects beyond the front edge of the former 16. This movement alters the part of the binder that is in contact with the former 16. This is of importance as the former 36 that moves always moves inwards to the same extent relative to the shaft 21. Accordingly the relative radial movement of the former 16, the teeth 12 during setting up with the cams and the flexure of the spring plate 15 presents the binder and pages to the moving former 36 in an optimum position to ensure that closure of the binder to the desired shape will occur.

The closer members 30 of the binding apparatus 1 are manually moved from the home position, shown in FIG. 1, to the crush position, shown in FIG. 2, by downwards movement of the handle 32 in an arcuate direction about the axis of shaft 21. As the motion of the handle 32 is contained in the crush position, and the locking mechanism releases and allows rotation of the hexagonal shaft 35 and the corresponding cams 34. As shown in FIG. 3, the anticlockwise rotation of the cams 34 causes the translational movement of the movable former 36 away from the hexagonal shaft and towards the opposing former 16. The movement of the former 36 causes the outer face 11 and inner face 13 of the binding member to inwardly rotate about the ridge 17 towards each other. The inward rotation of the upper parts of the loops on the inner face 13 causes the spring 26 to stretch and the holding teeth 12 to move towards the opposed former 36. Additionally, as the holding teeth project over the edge of the former 16, the spring plate 15 flexes further downwardly and minimises the restraining forces opposing the inward rotation of the inner face 13 of the binding member 10. During closure of the binder, the binder is not obstructed by any part above the binder and the only contact that occurs is by the formers and the support of the hooks.

The handle 32 rotates the cams 34 until the cams 34 abut a stop (not shown) (or reach the limit that they can cause inwards movement of the former 36) in which the movable former 36 has reached a predefined end point, shown by line 54 in FIGS. 5A to 5E. At this point the free edges of the two faces 11, 13 are intertwined such that a bound page cannot be removed from the binding member 10 without outwardly deforming the two faces 11, 13 away from each other. As shown in FIGS. 5A–5E, the final cross-section of the binding member 10 is substantially circular.

The movement of the former 36 causes a permanent change in the shape of the binding member such that a force would have to be applied to urge the free edges away from each other.

As the handle 32 is released from the final position shown in FIG. 3 a spring action first returns the handle 32 and the cams 34 and the closer members 30 to the open position shown in FIG. 1. This enables the easy removal of the bound pages.

The reader's attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

What I claim is:

1. Binding apparatus including a support, first and second formers, the support being for one elongate edge of an open binder, with the binder being supported by being suspended from the support and having an outer surface of the binder resting against the first former, the first and second formers being movable relatives to each other towards each other, the movement of the formers relative to each other, in use, being arranged to bring opposed edges of a binder towards each other to close a binder.

2. Apparatus according to claim 1 in which one elongate edge of a binder is arranged to be supported such that the other edge is arranged to receive pages to be bound.

3. Apparatus according to claim 1 in which the edge of a binder that is not supported is arranged to face upwardly.

4. Apparatus according to claim 1 in which the support is arranged to restrict movement of the binder away from the first former.

5. Apparatus according to claim 1 in which the support for a binder the binder including loops that extend along a length of the binder, the support for the binder being arranged to support the loops on a binder that extend along the length of the binder.

6. Apparatus according to claim 1 in which the support is arranged to overhang the first former.

7. Apparatus according to claim 6 in which the overhang includes an extent the extent of the overhang being adjustable.

8. Apparatus according to claim 1 in which the first and second formers have generally upwardly extending faces that are arranged to effect closure of a binder.

9. Apparatus according to claim 1 in which the second former is movable from a first position, in which it is clear of the first former to a second position in which the second former can be moved towards the first former to close a binder.

10. Apparatus according to claim 9 in which the first position of the second former is a raised position.

11. Apparatus according to claim 9 in which the second former is arranged to be pivoted to the first position.

12. Apparatus according to claim 9 in which a single movement of an operating member is arranged to bring the second former from the first position to a position in which it opposes the first former and then towards the first former to close a binder.

13. Binding apparatus including a support, first and second formers, the support being for one elongate edge of an open binder, with the support being associated with the first former, the first and second formers being movable relative to each other towards each other, the position of the support of the first former being adjustable in a direction extending between the first and second formers, the movement of the formers relative to each other, in use, being arranged to bring opposed edges of a binder towards each other to close a binder.

14. Binding apparatus including a support, first and second formers, the support being for one elongate edge of an open binder, the first and second formers being movable relative to each other towards each other, the movement of the formers relative to each other, in use, being arranged to bring opposed edges of a binder towards each other to close a binder, the first and second formers being adjustable relative to each other prior to the first and second formers being moved to bring the open edges of a binder towards each other, the apparatus further including a single member which single member is arranged to effect adjustment of the support and the first former.

15. Apparatus according to claim 14 in which the or each adjustment is arranged to be effected by a cam.

16. Apparatus according to claim 14 in which the adjustment is arranged to occur against a resilient bias.

17. Binding apparatus including a support, first and second formers, the support being for one elongate edge of an open binder, the first and second formers being movable relative to each other towards each other, the movement of the formers relative to each other, in use, being arranged to bring opposed edges of a binder towards each other to close a binder, the first and second formers being adjustable relative to each other prior to the first and second formers being moved to bring the open edges of a binder towards each other, adjustment of the support and the adjustment of the first former being arranged to occur simultaneously.

18. A method according to claim 17 comprising locating pages to be bound over the other edge while the one edge is supported, prior to the relative movement of the opposed edges occurring.

19. A method according to claim 17 comprising supporting the binder at one edge by suspending the binder.

20. A method as claimed in claim 17 comprising allowing an outer edge of the binder to bear against one of the formers prior to the formers moving towards each other.

21. A method according to claim 17 comprising altering the distance of one of the formers adjacent to the edge of the binder that is to be supported and the support for the edge of a binder in a general direction that the formers are arranged to move to bring opposed edges of a binder towards each other.

22. A method according to claim 17 comprising moving one of the formers to oppose the other prior to moving the formers relative to each other to bring opposed edges of the binder towards each other.

23. A method as claimed in claim 17 comprising moving a former or moving a support for one edge of a binder by means of a cam or against resilient means or simultaneously or any combination thereof.

24. A method according to claim 17 comprising causing one of the formers only to move when bringing the opposed edges of the binder towards each other.

25. A method according to claim 24 comprising always moving that former to the same extent, regardless of the size of a binder whose edges are moved towards each other.

26. A method according to claim 17 comprising supporting a binder comprising a single elongate component formed to present loops along each elongate edge with the loops along one edge, and possibly each loop along that edge, being supported.

27. A method according to claim 17 comprising moving one of the formers from a first position in which it is clear of the other former, in order that the binder can be mounted on the support, to a second position in which it is in the region of the other support and then moving the formers relative to each other to bring the opposed edges of the binder towards each other.

28. A method as claimed in claim 17 comprising moving the former from the first position to the second position and then causing that former to move towards the other former to bring the edges of the binder towards each other in one continuous movement or on operation of one member.

29. A method as claimed in claim 28 in which that movement of the former is initially arcuate and subsequently translational.

30. Binding apparatus including a support, first and second formers, the support being for one elongate edge of an open binder, the first and second formers being movable relative to each other towards each other, the movement of the formers relative to each other, in use, being arranged to bring opposed edges of a binder towards each other to close a binder, the second former being arranged always to move a fixed distance during movement towards the first former in order to close a binder regardless of the size of the binder that is being closed.

31. A method of binding an elongate binder having opposed spaced edges along its elongate extent comprising supporting the binder at one edge thereof and causing relative movement of the opposed formers towards each other in order to bring the opposed edges of the binder towards each other, the support for the binder at one edge moving in a general direction between the formers.

32. A method according to claim 31 comprising the support for the binder moving against a resilient bias, either when pages are being loaded onto the binder or when the opposed edges of the binder are moved towards each other or both.

* * * * *